US008851090B2

(12) United States Patent
Bradshaw

(10) Patent No.: US 8,851,090 B2
(45) Date of Patent: Oct. 7, 2014

(54) GOLF TOWEL

(75) Inventor: Bruce A. Bradshaw, Clarion, IA (US)

(73) Assignee: Team Effort, Inc., Clarion, IA (US)

( * ) Notice: Subject to any disclaimer, the term of this patent is extended or adjusted under 35 U.S.C. 154(b) by 763 days.

(21) Appl. No.: 12/693,065

(22) Filed: Jan. 25, 2010

(65) Prior Publication Data

US 2011/0180102 A1 Jul. 28, 2011

(51) Int. Cl.
*B08B 3/04* (2006.01)
*A63B 57/00* (2006.01)
*A63B 47/04* (2006.01)

(52) U.S. Cl.
CPC ..... *A63B 57/0087* (2013.01); *A63B 2047/043* (2013.01)
USPC ..... 134/104.2; 134/93; 15/210.1; 442/268

(58) Field of Classification Search
None
See application file for complete search history.

(56) References Cited

U.S. PATENT DOCUMENTS

| | | | | |
|---|---|---|---|---|
| 2,179,614 | A | 11/1939 | Cohen | |
| 2,990,554 | A * | 7/1961 | Nelson | 112/475.09 |
| 4,912,800 | A | 4/1990 | Zeltner | |
| 5,067,400 | A | 11/1991 | Bezella et al. | |
| 5,075,918 | A | 12/1991 | Zeltner et al. | |
| 5,331,705 | A | 7/1994 | Melov | |
| 5,394,914 | A | 3/1995 | Meek | |
| D363,404 | S | 10/1995 | Cute | |
| 5,591,507 | A | 1/1997 | Jones | |
| 5,761,761 | A | 6/1998 | An | |
| 5,770,284 | A | 6/1998 | Logemann | |
| 5,902,661 | A | 5/1999 | Oster | |
| 6,003,190 | A | 12/1999 | Knudsen | |
| 6,076,224 | A | 6/2000 | Pacifico et al. | |
| 6,186,155 | B1 | 2/2001 | Cheek | |
| 6,226,827 | B1 | 5/2001 | English, Jr. | |
| 6,386,129 | B1 * | 5/2002 | Uto | 112/104 |
| 6,550,093 | B1 | 4/2003 | Shioda | |
| 6,560,812 | B1 | 5/2003 | Pettway | |
| D506,099 | S | 6/2005 | Muse | |
| 7,219,388 | B2 | 5/2007 | Hale | |
| 7,302,728 | B2 | 12/2007 | Kunz | |
| 7,484,262 | B2 | 2/2009 | Cotton | |
| 2003/0233717 | A1 | 12/2003 | Ortega et al. | |
| 2004/0060496 | A1 * | 4/2004 | Kirkland et al. | 112/475.06 |
| 2004/0194242 | A1 | 10/2004 | Ortega et al. | |
| 2006/0005335 | A1 | 1/2006 | Ortega et al. | |
| 2006/0037163 | A1 | 2/2006 | Steinway | |
| 2006/0075589 | A1 | 4/2006 | Choi | |
| 2009/0193598 | A1 | 8/2009 | Sprague | |

* cited by examiner

*Primary Examiner* — Eric Golightly
(74) *Attorney, Agent, or Firm* — McKee, Voorhees & Sease

(57) ABSTRACT

An apparatus which includes a towel body formed from a single piece of fabric and having a top side and an opposite bottom side and formed of a towel material. The towel body has a soft terry cloth portion suitable for polishing a golf club head and a weaved portion at a first end of the towel body, the weaved portion having grooves to present a rough surface for cleaning a golf ball or a golf club head. There is a first binding on the first end of the towel body formed by folding over a first end of the single piece of fabric on itself and stitching. There is a second binding on the second end of the towel body formed by folding over the second end of the single piece of fabric on itself and stitching. There are also edge bindings along the edges of the towel body between the first end and the second end formed by stitching along edges of the single piece of fabric.

8 Claims, 2 Drawing Sheets

GOLF TOWEL

FIELD OF THE INVENTION

The present invention generally relates to an apparatus for cleaning golf balls, golf clubs, and other golf equipment. More particularly, the present invention relates to a golf towel having a plurality of different types of surfaces.

BACKGROUND OF THE INVENTION

Golf equipment, including golf clubs and golf balls will collect dirt or other types of debris during typical use. Examples of other types of debris may include grass, sand, or other material. The accumulation of such debris may adversely affect the performance of the golf equipment. Therefore, golfers will clean their golf clubs and golf balls.

One type of golf towel is the terry cloth towel. Some golfers may wet the towel to assist in cleaning their golf equipment. Yet, use of such a towel (even if wet) will still make it difficult to clean a golf club face. What is needed is an improved golf towel that may be used for both abrading dirt and debris from golf club heads as well as for polishing golf club heads.

SUMMARY OF THE INVENTION

Therefore, it is a primary object, feature, or advantage of the present invention to improve over the state of the art.

It is a further object, feature, or advantage of the present invention to provide an improved golf towel.

It is yet a further object, feature, or advantage of the present invention to provide a golf towel that may be used for both abrading dirt and debris from golf balls or golf club heads (or other equipment) as well as polishing golf club heads (or other equipment).

Yet another object, feature, or advantage of the present invention is to provide a golf towel that is formed from a single piece of fabric.

A still further object, feature, or advantage of the present invention is to provide a golf towel that is of high quality and which is highly desirable to golfers.

One or more of these and/or other objects, features, or advantages of the present invention will become apparent from the specification and claims that follow. No single embodiment of the present invention need exhibit each and every one of these objects, features, or advantages.

According to one aspect of the present invention in apparatus is provided. The apparatus includes a towel body formed from a single piece of fabric and having a top side and an opposite bottom side and formed of a towel material. The towel body has a soft terry cloth portion suitable for polishing a golf club head and a weaved portion at a first end of the towel body, the weaved portion having grooves to present a rough surface for cleaning a golf ball or the head of a golf club. There is a first binding on the first end of the towel body formed by folding over a first end of the single piece of fabric on itself and stitching. There is a second binding on the second end of the towel body formed by folding over a second of the single piece of fabric on itself and stitching. There are also edge bindings along the edges of the towel body between the first end and the second end formed by stitching along edges of the single piece of fabric.

According to another aspect of the present invention, a method of cleaning a golf club head of a golf club is provided. The method includes acquiring a golf club head cleaning apparatus. The golf club head cleaning apparatus includes a towel body formed from a single piece of fabric and having a top side and an opposite bottom side and formed of a towel material. The towel body has a soft terry cloth portion suitable for polishing a golf club head and a weaved portion at a first end of the towel body, the weaved portion having grooves to present a rough surface for cleaning the head of a golf club. The towel body further includes a first binding on the first end of the towel body formed by folding over a first end of the single piece of fabric on itself and stitching and a second binding on the second end of the towel body formed by folding over a second of the single piece of fabric on itself and stitching. The towel body also includes edge bindings along the edges of the towel body between the first end and the second end formed by stitching along edges of the single piece of fabric. The method further includes abrading dirt or debris from the golf club head using the weaved portion of the towel body of the golf club head cleaning apparatus.

DETAILED DESCRIPTION

Figure 1:
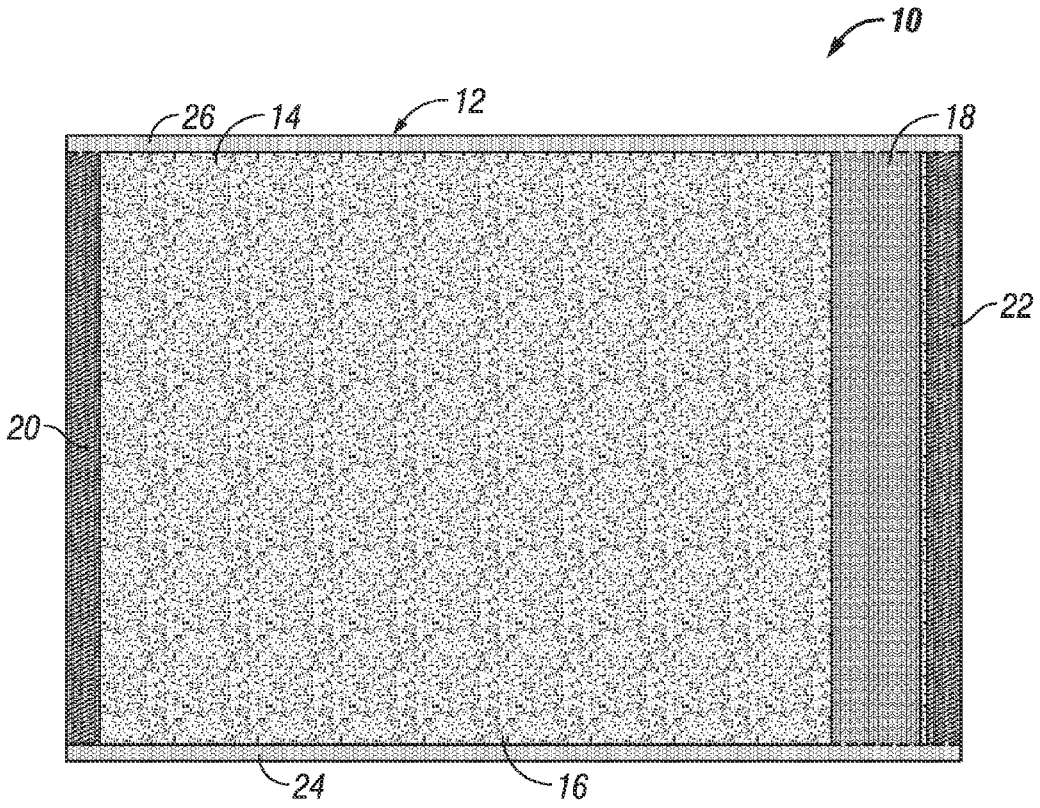
FIG. 1 is a top view of one embodiment of a golf towel.
Figure 2:
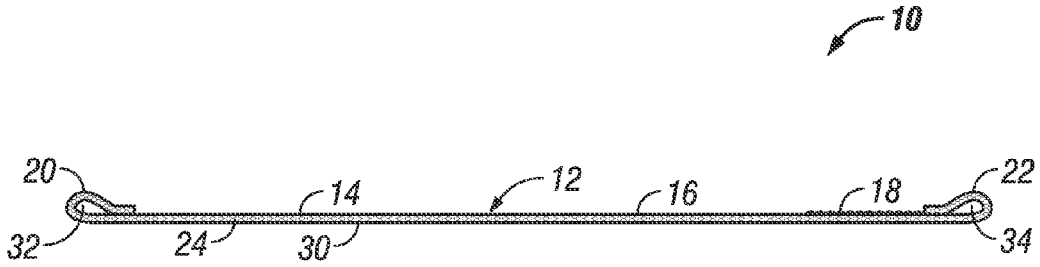
FIG. 2 is a side view of the golf towel.

Referring now to FIGS. 1-2, an exemplary embodiment of the present invention is shown which provides significant advantages and benefits. The golf towel 10 is shown to include a towel body 12 formed from a single piece of fabric and having a top side 14 and an opposite bottom side 30. The towel body 12 has a soft terry cloth portion 16 suitable for polishing a golf club head and a weaved portion 18 at a first end of the towel body 12, the weaved portion 18 having grooves to present a rough surface for cleaning the head of a golf club. There is a first binding 20 on the first end of the towel body 12 formed by folding over a first end of the single piece of fabric on itself and stitching. There is a second binding 22 on the second end of the towel body 12 formed by folding over a second end of the single piece of fabric on itself and stitching. There are also edge bindings 24, 26 along the edges of the towel body 12 between the first end and the second end formed by stitching along edges of the single piece of fabric.

As can be seen in FIG. 1, towel body 12 is generally rectangular in shape and having edge bindings 24, 26 running lengthways along the edges of the towel body 12. The towel body 12 further has a first binding 20 and a second binding 22 running along a width of the towel body 12. The bindings form a border with raised areas and may be useful for cleaning a golf club or golf ball. The golf towel 10 has a plurality of different surfaces formed from a single material: soft terry cloth portion 16, weaved portion 18, first binding 20, second binding 22 and edge bindings 24, 26. The single piece of fabric forming towel body 12 may be a cotton fabric that is dark in color. As shown in FIG. 2, the towel body 12 has a top side 14 and a bottom side 30. The top side 14 may be configured to have open loops 32, 34 at first and second ends. It is further contemplated that a tag can be attached to the towel body 12 or a name or logo stitched in the towel body 12.

Figure 3:
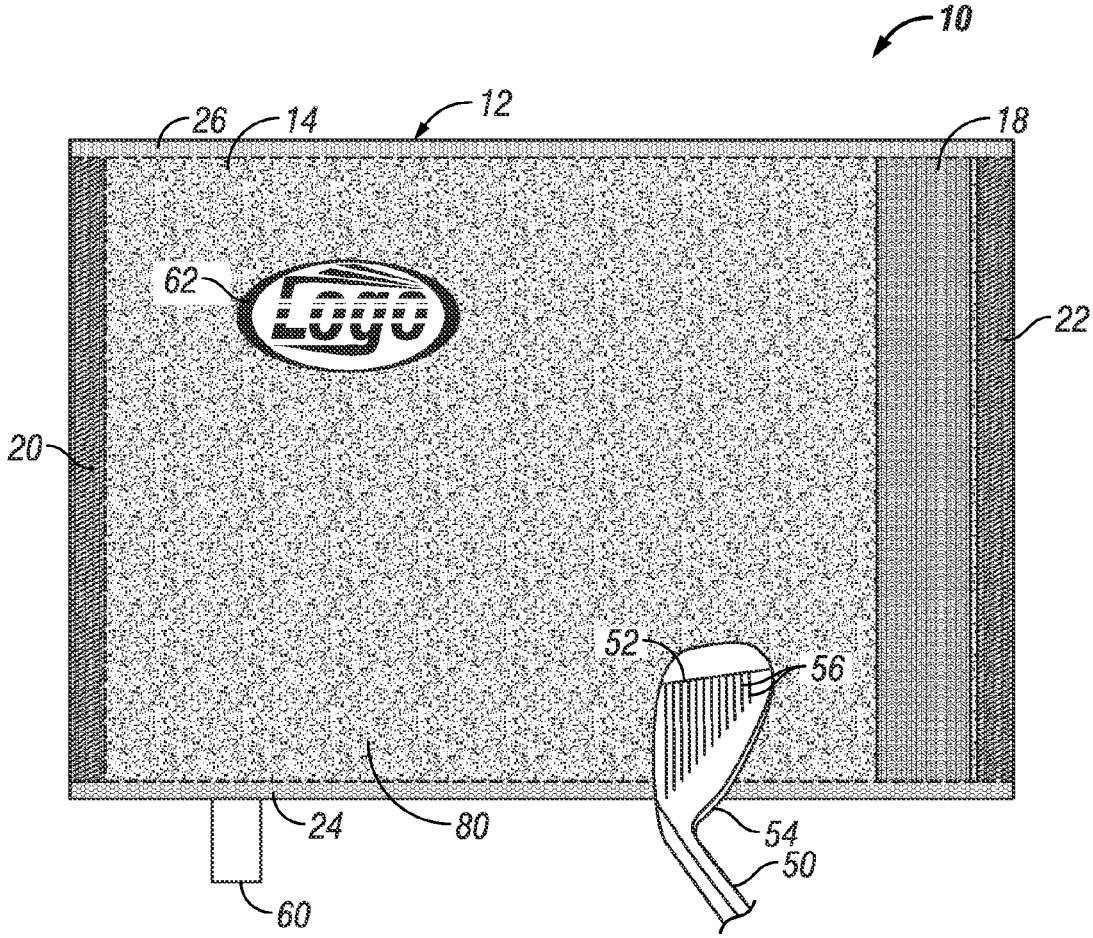
FIG. 3 is a view of a golf club head being cleaned with the golf towel.

As best shown in FIG. 3, the golf towel 12 can be used to polish a golf club 50 or golf ball. For instance, a user could polish a golf club face 52 or golf club head 54 using the soft terry cloth portion 16. The rough surface of the weaved portion 18 could then be used to clean the golf club head 54 and, more particularly, the grooves 56 disposed on the golf club face 52. The golf towel 12 can further be outfitted with a tag

60 attached to the towel body 12 and a name or logo 62 on the towel body 12. The weaved portion 18 of the towel body 12 can further be used for cleaning a golf ball. The dimples of a golf ball often collect dirt and accordingly need to be abraded with a rough surface. The weaved portion 18 in an exemplary embodiment has a width of approximately 3 inches such that the weaved portion 18 has a width generally at least the width of a club face of a golf club.

Further provided is a method of cleaning a golf club head 54 of a golf club 50. The method includes acquiring a golf club head cleaning apparatus. The golf club head cleaning apparatus includes a towel body 12 formed from a single piece of fabric and having a top side 14 and an opposite bottom side 30. The towel body 12 has a soft terry cloth portion 16 suitable for polishing a golf club head 54 and a weaved portion 18 at a first end of the towel body 12, the weaved portion 18 having grooves to present a rough surface for cleaning a golf club head 54. The towel body 12 further includes a first binding 20 on the first end of the towel body 12 formed by folding over a first end of the single piece of fabric on itself and stitching and a second binding 22 on the second end of the towel body formed by folding over a second end of the single piece of fabric on itself and stitching. The towel body 12 also includes edge bindings 24, 26 along the edges of the towel body 12 between the first end and the second end formed by stitching along edges of the single piece of fabric. The method further includes abrading dirt or debris from the golf club head 54 using the weaved portion 18 of the towel body 12 of the golf club head cleaning apparatus.

In operation, a golfer may place golf club head 54 on the towel body 12. The golfer may then wrap the weaved portion 18 around the golf club head 54 such that the weaved portion 18 interacts with the golf club face 52. The golfer may then manipulate the weaved portion 18 of the towel body 12 to abrade dirt embedded within the grooves 56 of the golf club face 52. Next, the golfer may use the soft terry cloth portion 16 to polish the golf club head 54. In a similar manner a golfer may clean a golf ball, e.g., the golf ball can be placed within the towel body 12 and then the weaved portion 18 may be manipulated to abrade dirt on the golf ball.

Having thus described an exemplary embodiment of the apparatus and method for a cleaning a golf club head of a golf club, it should be apparent to those skilled in the art that certain advantages of the present invention have been achieved. It should also be appreciated that various modifications, adaptations, and alternatives may be made. For instance, a different material could be used to form the towel body or the towel body can be made into varying shapes and sizes. It is of course not possible to describe every conceivable modification, adaptation, and alternative for purposes of describing the present invention. All such possible modifications, adaptations, and alternatives are to be included within the spirit and scope of the present invention which is to be limited only by the following claims.

What is claimed is:

1. An apparatus, comprising:

a towel body formed from a single piece of fabric and a top side and an opposite bottom side and formed of a towel material;

the single piece of fabric forming the towel body comprising a soft terry cloth portion suitable for polishing a golf club head, and a weaved portion at a first end of the towel body, the weaved portion having grooves to present a rough surface for cleaning the head of a golf club head;

a first binding on the first end of the towel body formed by folding over the first end of the single piece of fabric on itself and stitching;

a second binding on the second end of the towel body formed by folding over the second end of the single piece of fabric on itself and stitching; and edge bindings along the edges of the towel body between the first end and the second end formed by stitching along edges of the single piece of fabric.

2. The apparatus of claim 1 wherein the weaved portion is used for cleaning a golf ball.

3. The apparatus of claim 1 wherein the single piece of fabric is a cotton fabric.

4. The apparatus of claim 1 wherein the first binding and the second binding comprise open loops.

5. The apparatus of claim 1 wherein the weaved portion has a width of approximately 3 inches such that the weaved portion has a width generally at least the width of a club face of a golf club.

6. The apparatus of claim 1 further comprising a tag attached to the towel body.

7. The apparatus of claim 1 further comprising a name or logo stitched in the towel body.

8. The apparatus of claim 1 wherein the single piece of fabric is dark in color.

* * * * *